US011248442B2

(12) United States Patent
Barlow et al.

(10) Patent No.: US 11,248,442 B2
(45) Date of Patent: Feb. 15, 2022

(54) SURGE ASSEMBLY WITH FLUID BYPASS FOR WELL CONTROL

(71) Applicant: HALLIBURTON ENERGY SERVICES, INC., Houston, TX (US)

(72) Inventors: Darren Ross Barlow, Houston, TX (US); Scott Randall Von Kaenel, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/709,122

(22) Filed: Dec. 10, 2019

(65) Prior Publication Data

US 2021/0172286 A1 Jun. 10, 2021

(51) Int. Cl.
*E21B 34/10* (2006.01)

(52) U.S. Cl.
CPC ..... *E21B 34/10* (2013.01); *E21B 2200/06* (2020.05)

(58) Field of Classification Search
CPC ..... E21B 34/14; E21B 34/10; E21B 2200/06
See application file for complete search history.

(56) References Cited

U.S. PATENT DOCUMENTS

| | | | | |
|---|---|---|---|---|
| 3,743,021 | A | 7/1973 | McCauley et al. | |
| 5,960,881 | A | 10/1999 | Allamon et al. | |
| 6,296,058 | B1 | 10/2001 | Brieger | |
| 6,321,847 | B1 * | 11/2001 | Brown | E21B 23/04 166/374 |
| 7,243,725 | B2 | 7/2007 | George et al. | |
| 8,302,688 | B2 | 11/2012 | Burleson et al. | |
| 2003/0066643 | A1 | 4/2003 | Ringgenberg et al. | |
| 2004/0000406 | A1 | 1/2004 | Allamon et al. | |
| 2006/0011354 | A1 | 1/2006 | Logiudice et al. | |
| 2011/0114334 | A1 * | 5/2011 | Palacios | E21B 23/04 166/373 |
| 2014/0262324 | A1 * | 9/2014 | Greci | E21B 43/12 166/374 |

FOREIGN PATENT DOCUMENTS

WO WO 2010-065554 6/2010

OTHER PUBLICATIONS

Schlumberger—"TRUST—Transient rapid underbalance surge technique"; Perforating Well Completions; Copyright 2012; 1 page; https://www.slb.com/-/media/files/pe/product-sheet/trust-ps.ashx.

International Search Report and Written Opinion issued by the ISA/KR for related international application No. PCT/US2019/065961, dated Sep. 7, 2020, 10 pages.

* cited by examiner

*Primary Examiner* — Dany E Akakpo
(74) *Attorney, Agent, or Firm* — Haynes and Boone, LLP

(57) ABSTRACT

A method of providing an underbalance in a wellbore that includes positioning a surge assembly within the wellbore; bypassing a differential chamber that extends along a portion of the length of the surge assembly when flowing fluid through a fluid passageway that extends along the length of the surge assembly; and placing the fluid passageway in fluid communication with the air chamber to create an underbalance in the fluid passageway.

11 Claims, 7 Drawing Sheets

SURGE ASSEMBLY WITH FLUID BYPASS FOR WELL CONTROL

TECHNICAL FIELD

The present disclosure relates generally to a surge assembly, and specifically, to a surge assembly with a fluid bypass that allows for well control before and after the surge assembly has been actuated.

BACKGROUND

During well completion operations, it is often beneficial to create an underbalance or at least a temporary reduction of fluid pressure within the wellbore. For example, a pressure underbalance allows perforations to surge and clean, and also lowers the skin effect due to damage in the formation. Generally, to create a pressure underbalance, a surge assembly that includes a differential chamber, such as an air chamber, is positioned within the wellbore. The differential chamber is flooded or surged via a valve with fluid from the wellbore to create the temporary pressure underbalance. Conventionally, the differential chamber is formed between two ball valves in tubing, which eliminates the ability to use the tubing as a conduit. As such, firing heads or other downhole tools that form a portion of the working string cannot be activated when the surge assembly is positioned between the downhole tool and the surface of the well. Thus, additional trips downhole are required to position the surge assembly after the downhole tools are activated. This requires additional time and expense during well completion operations.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Illustrative embodiments and related methods of the present disclosure describe a surge assembly with fluid bypass for well control and methods of operating the same. The surge assembly often forms a portion of a working string that extends from the surface of a well to a downhole tool, with the surge assembly being positioned between the surface and the downhole tool. Generally, the surge assembly has a fluid passageway that extends along its entire length and a differential chamber that extends along at least a portion of its length. The fluid passageway and differential chamber are formed in a housing and are fluidically isolated by a valve when the valve is in the closed position. Initially, the valve remains closed to allow fluid to flow through the fluid passageway while bypassing the differential chamber. In some embodiments the valve is opened via a ball drop, which isolates an uphole portion of the fluid passageway and places a downhole portion of the fluid passageway in fluid communication with the differential chamber to create a pressure drop or an underbalance in the well. Upon removal of the ball, the downhole tool can be actuated or otherwise operated via the fluid passageway. Generally, the surge assembly allows fluid to flow through the surge assembly via the fluid passageway while bypassing the differential chamber. This allows for the downhole tool to be operated via the fluid passageway even with the presence of a differential chamber and operated after the underbalance event, which improves well control. Moreover, in some embodiments, the valve has multiple configurations, with each configuration associated with a target flow rate or target flow rate range.

Figure 1:
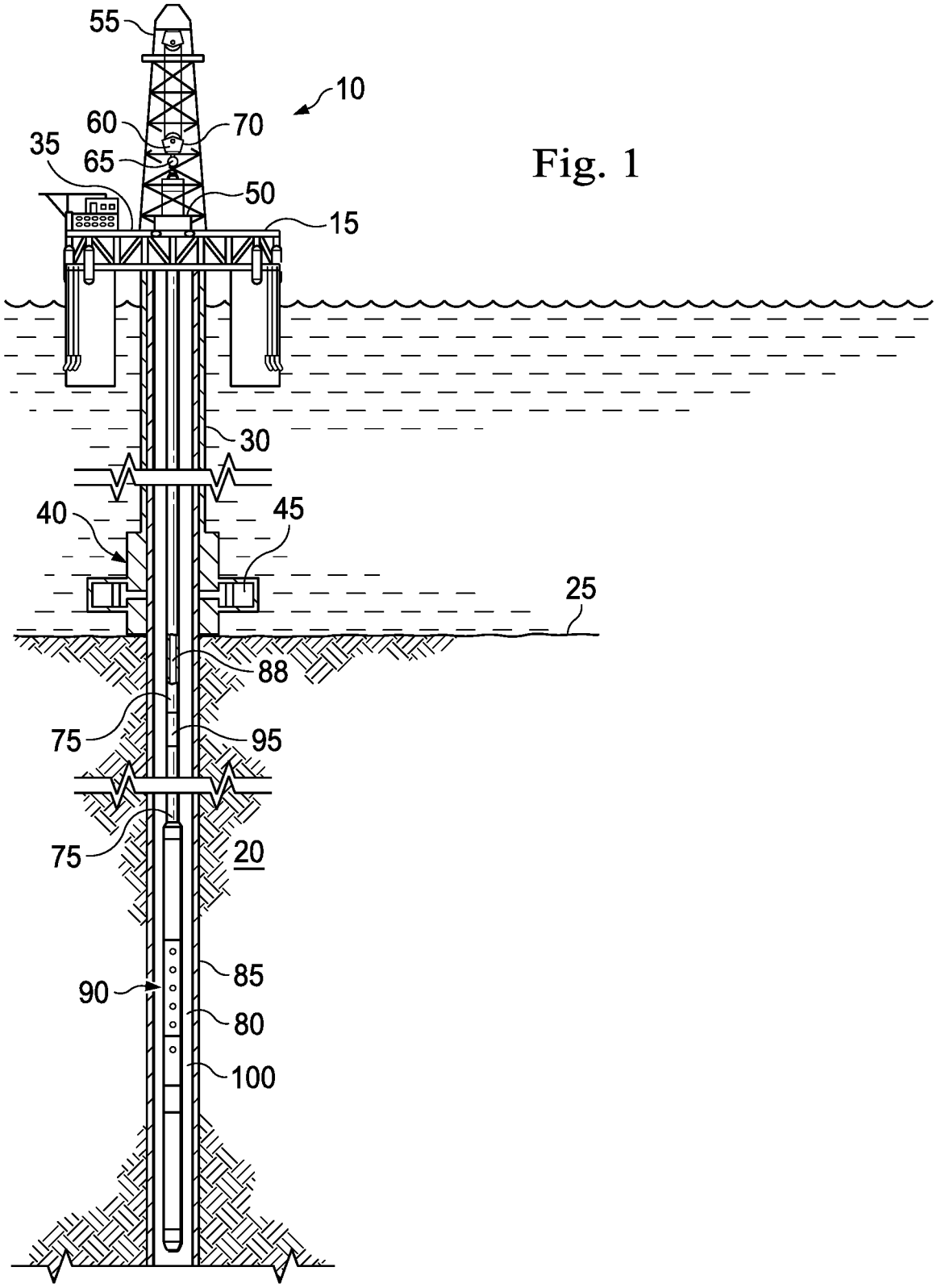
FIG. 1 is a schematic illustration of an offshore oil and gas platform operably coupled to a working string that includes a surge assembly, according to an example embodiment of the present disclosure.

FIG. 1 is a schematic illustration of an offshore oil and gas platform operably coupled to a working string that includes a surge assembly. The offshore oil and gas platform is generally designated 10, while the surge assembly is generally designated as 95 and includes a fluid bypass for well control. Surge assembly 95 could alternatively be coupled to a semi-sub or a drill ship as well. Also, even though FIG. 1 depicts an offshore operation, it should be understood by those skilled in the art that the apparatus according to the present disclosure is equally well suited for use in onshore operations. By way of convention in the following discussion, though FIG. 1 depicts a vertical wellbore, it should be understood by those skilled in the art that the apparatus according to the present disclosure is equally well suited for use in wellbores having other orientations including horizontal wellbores, slanted wellbores, multilateral wellbores, or the like. Referring still to the offshore oil and gas platform example of FIG. 1, a semi-submersible platform 15 may be positioned over a submerged oil and gas formation 20 located below a sea floor 25. A subsea conduit 30 may extend from a deck 35 of the platform 15 to a subsea wellhead installation 40, including blowout preventers 45.

The platform 15 may have a hoisting apparatus 50, a derrick 55, a travel block 60, a hook 65, and a swivel 70 for raising and lowering pipe strings, such as a substantially tubular, axially extending running or working string 75.

As in the present example embodiment of FIG. 1, a borehole or wellbore 80 extends through the various earth strata including the formation 20, with a portion of the wellbore 80 having a casing string 85 cemented therein. The working string 75 defines a fluid passageway 88 and extends from a surface of the wellbore 80 to a downhole tool 90 positioned within the wellbore 80. Surge assembly 95 with a fluid bypass for well control is positioned within the working string 75 between the downhole tool 90 and the surface of the wellbore. However, in some embodiments, the downhole tool 90 or other downhole tools can be positioned within the working string 75 between the surge assembly 95 and the surface of the well. An annulus 100 is formed between an external surface of the working string 75 and the casing string 85 for cased-hole wellbores and the formation for open-hole wellbores (i.e., no casing).

Figure 2:
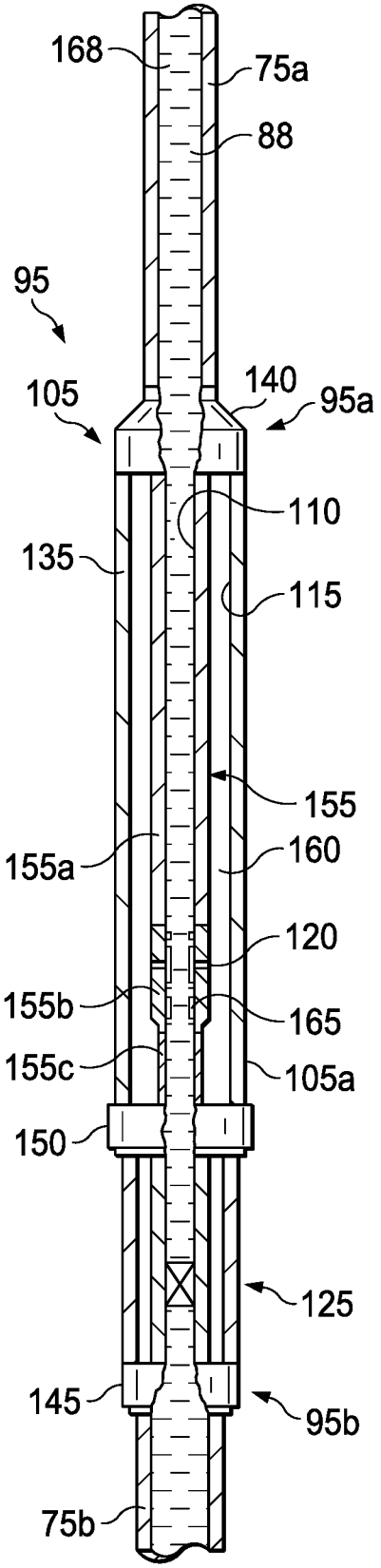
FIG. 2 illustrates a cross-sectional view of the surge assembly of FIG. 1 in a first configuration and having a valve, according to an embodiment of the present disclosure.

FIG. 2 illustrates a cross-sectional view of the surge assembly of FIG. 1 in a first configuration and having a valve. As illustrated, surge assembly 95 generally includes a housing 105 with a fluid passageway 110 extending therethrough. Also formed in housing 105 is a differential chamber 115. A first valve 120 fluidically isolates the differential chamber 115 from the fluid passageway 110 when in the closed position; and a second valve 125 that fluidically isolates one portion of the fluid passageway 110 from another portion of the fluid passageway 110 when in a closed position. As illustrated, the assembly 95 has a first end portion 95*a* that is coupled to a first tubular 75*a* of the tubing string 75 and a second opposing end portion 95*b* that is coupled to a second tubular 75*b* of the tubing string 75.

Generally, the housing 105 includes an outer tubular 135. In some embodiments, the housing 105 also includes a first crossover 140 that couples the first end portion 95*a* with the first tubular 75*a*, a second crossover 145 that couples the second end portion 95*b* with the second tubular 75*b*, and a third crossover 150 that is positioned between the first and second crossovers 140 and 145. In some embodiments, the crossovers 140, 145, and 150 are 3-way crossovers with seals, but the crossovers 140, 145, and 150 may be any type of assembly used to enable two components with different sizes or threads to be connected. Generally, the housing 105 fluidically isolates the surge assembly 95 from the fluid within the annulus 100 formed by an exterior surface 105*a* of the housing 105.

Generally, the fluid passageway 110 extends from the first end portion 95*a* and to the second end portion 95*b* of the surge assembly 95 while bypassing the differential chamber 115 when the first valve 120 is closed. As illustrated in FIG. 2, the fluid passageway 110 is formed or defined by an inner tubular 155. The inner tubular 155 forms a portion of the fluid passageway 88 and is in fluid communication with the fluid passageway 88 formed in the first tubular 75*a* and with the fluid passageway 88 formed in the second tubular 75*b*. In some embodiments, the fluid passageway 110 is placed in fluid communication with the fluid passageway 88 formed in the second tubular 75*b* upon the second valve 125 opening. In some embodiments, the inner tubular 155 is formed from three tubulars 155*a*, 155*b*, and 155*c* coupled together in series.

Generally, the differential chamber 115 extends along a portion of the length of the surge assembly 95 and is fluidically isolated from the fluid passageway 110 when the first valve 120 is in the closed position. As illustrated in FIG. 2, an annulus 160 is formed between the inner tubular 155 and the outer tubular 135, with the differential chamber 115 being formed or defined by the annulus 160. The annulus 160 is in part defined or formed by the first crossover 140 and the third crossover 150 as illustrated. While illustrated in FIG. 2 as being empty in the first configuration, the differential chamber 115 may be filled with a liquid. In some embodiments, the liquid is less dense than a fluid circulating or passing through the fluid passageway 110. In some embodiments, the differential chamber 115 is an air chamber that accommodates air either at atmospheric pressure or at a pressurized predetermined pressure. The liquid within the differential chamber 115 may be a liquid, a gas, or any mixture thereof. In some embodiments, the differential chamber 115 defines an actual volume that corresponds to a maximum volume of fluid that can be accommodated in the differential chamber 115, and an effective volume that corresponds to the maximum volume of fluid that can enter the differential chamber 115 when the differential chamber 115 is placed in fluid communication with the fluid passageway 110. The effective volume is dependent upon the type of fluid held in the differential chamber 115 when the differential chamber 115 is positioned within the wellbore. Generally, the effective volume increases as the density of the fluid held in the differential chamber 115 decreases. In some embodiments, and when the actual volume of the differential chamber 115 would result in an undesirable underbalance situation, fluids are selected to be held in the differential chamber 115 such that the effective volume results in a desired underbalance situation. As the effective volume is variable based on the fluids held in the differential chamber 115, the effective volume is customizable. In some embodiments, two different fluids are accommodated in the differential chamber 115 before the surge assembly 95 is positioned in the wellbore. Examples of a gas accommodated in the differential chamber 115 before the surge assembly 95 is positioned in the wellbore include air, nitrogen, and/or any noble gas. Examples of a liquid accommodated in the differential chamber 115 before the surge assembly 95 is positioned in the wellbore include calcium bromide, any base oil, etc. As noted, a combination of fluids may be accommodated within the differential chamber 115 before the surge assembly 95 is positioned in the wellbore to customize the effective volume of the surge assembly 95.

Generally, the first valve 120 is formed at least in part by the inner tubular 155 and includes a sliding sleeve 165 that is positioned within the inner tubular 155. The sliding sleeve 165 is disposed within the fluid passageway 110 and moves relative to the inner tubular 155 to open and close the first valve 120.

Generally, the second valve 125 is positioned between the second crossover 145 and the third crossover 150 and fluidically isolates an uphole portion of the fluid passageway 110 from a downhole portion of the fluid passageway 110 when in a closed position and places the uphole portion of the fluid passageway 110 in fluid communication with the uphole portion of the fluid passageway 110 when in an open position. In some embodiments, the second valve 125 includes a mechanical actuation system such as a ball drop system but can also include electro-mechanical actuations systems. Generally, and when in the first configuration, a fluid 168 that is in communication with the surface is capable of flowing through the passageway 88 unimpeded through the surge assembly 95.

Figure 3:
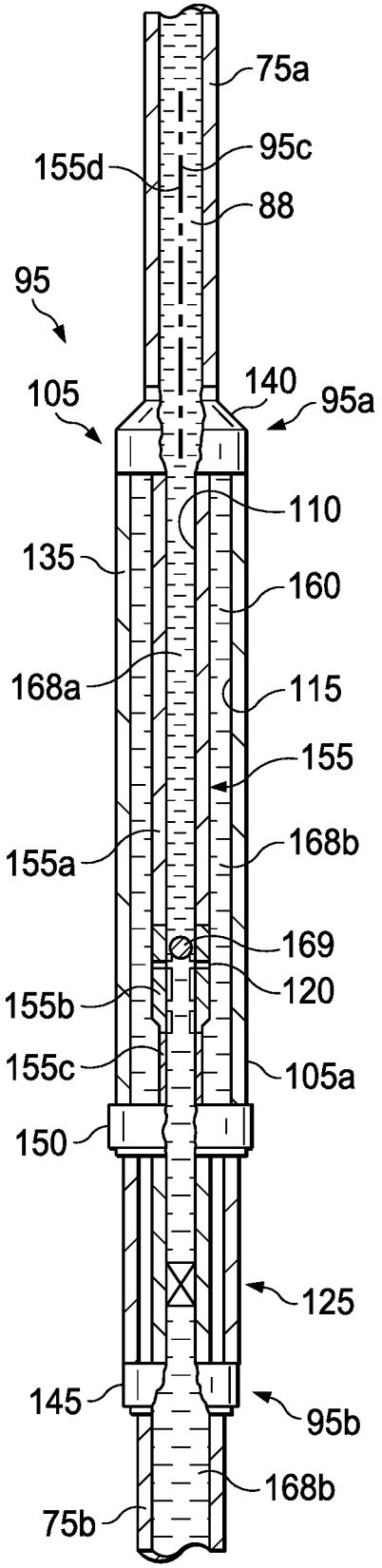
FIG. 3 illustrates a cross-sectional view of the surge assembly of FIG. 2 in a second configuration, according to an embodiment of the present disclosure.

FIG. 3 illustrates a cross-sectional view of the surge assembly of FIG. 2 in a second configuration. In the second configuration, a ball 169 has been landed on the first valve 120 and the fluid passageway 110 is blocked such that an uphole portion 110*a* (relative to the ball 169) accommodates a fluid 168*a* that is in communication with the surface but is fluidically isolated or substantially fluidically isolated from a downhole portion 110*b* (relative to the ball 169) that accommodates a fluid 168*b* that is in communication with an end portion of the working string 75 and/or the annulus 100. Moreover, and in the second configuration, the valve 120 has been shifted to an open position so that the fluid 168*b* enters the differential chamber 115 from the downhole portion 110*b* of the fluid passageway 110. As the downhole portion 110*b* of the fluid passageway 110 is in fluid communication with the annulus 100, the annulus 100 is affected and an underbalance occurs (i.e., temporary reduction in downhole fluid pressure that is or is not lower than the formation pressure). In some embodiments, the surge assembly 95 is positioned above the perforation interval and the packers are reset before the valve 120 is opened. In some embodiments, the inner tubular 155 has a longitudinal axis 155*d* that aligns with a longitudinal axis 95*c* of the surge assembly 95 while in other embodiments the longitudinal axis of the inner tubular 155 is offset from the longitudinal axis of the surge assembly 95. As illustrated, the fluid passageway 110 extends along the entirety of the longitudinal axes 155*d* and 95*c*.

Figure 4:
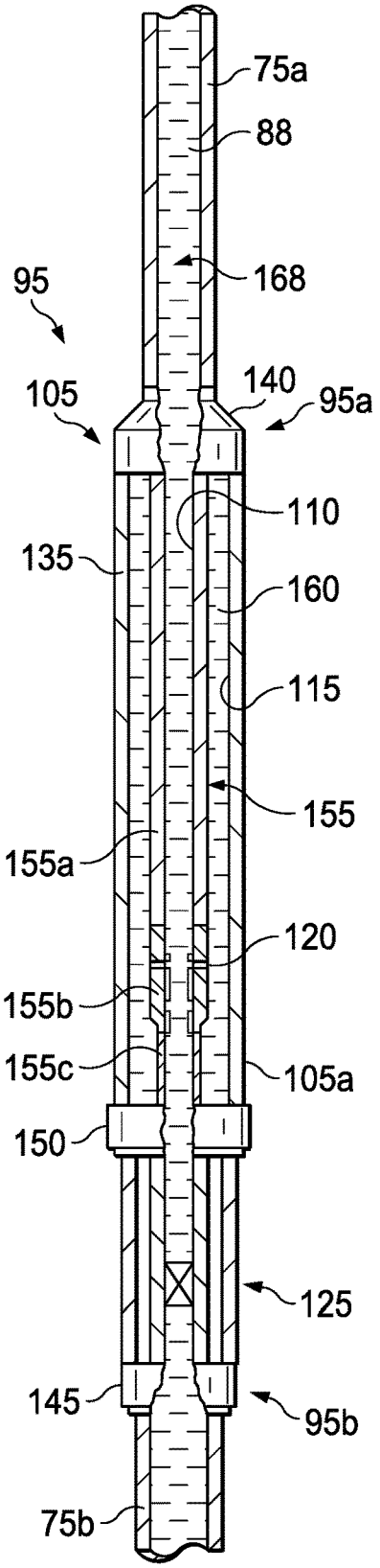
FIG. 4 illustrates a cross-sectional view of the surge assembly of FIG. 2 in a third configuration, according to an embodiment of the present disclosure.

FIG. 4 illustrates a cross-sectional view of the surge assembly of FIG. 2 in a third configuration. In this third configuration, as illustrated, the ball 169 is removed from the first valve 120 and the fluid passageway 110, and the fluid 168 resumes flowing through the fluid passageway 110. As such, the fluid passageways 88 and 110 is unimpeded.

Figure 5:
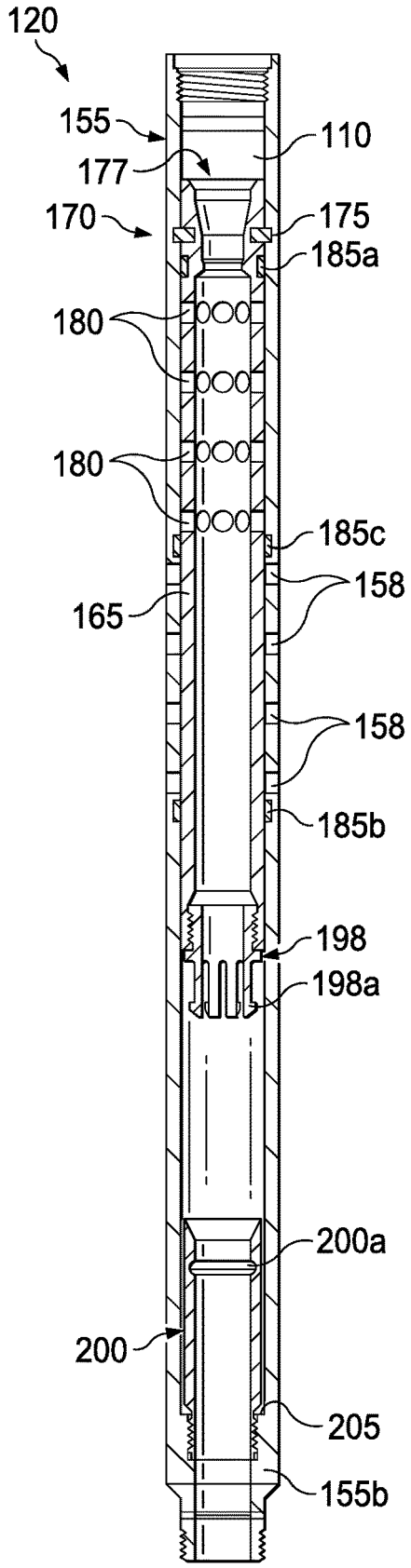
FIG. 5 illustrates a cross-sectional view of the valve of FIG. 2 in a closed position, according to an embodiment of the present disclosure.

FIG. 5 illustrates a cross-sectional view of the valve of FIG. 2 in a closed position. As illustrated, a plurality of openings 158 are formed in a wall of a portion of the inner tubular 155. The sliding sleeve 165 is disposed within the fluid passageway 110 and secured, using an actuation system 170 relative to the inner tubular 155. In some embodiments and as illustrated, the actuation system 170 includes a plurality of shear pins 175 that are coupled to the sliding sleeve 165 and the inner tubular 155 to secure the sliding sleeve 165 relative to the inner tubular 155. The actuation system 170 also includes a ball seat 177 that is formed in or otherwise attached to the sliding sleeve 165, such that force applied to the ball seat 177 via the dropped ball 169 is transferred to the shear pins 175. The actuation system 170 is not limited to a drop ball type actuation system and can include any number of mechanical and electromechanical actuation systems. The sliding sleeve 165 includes a plurality of openings 180 that are formed through a wall of the sliding sleeve 165. In some embodiments, the openings of the plurality of openings are spaced circumferentially about the sliding sleeve 165 and/or spaced along the length of the sliding sleeve 165. As illustrated, the size of the openings and the spacing of the openings are generally consistent. However, the size of the openings and the spacing can vary along the circumference of the sliding sleeve 165 and along the length of the sliding sleeve 165. Seals are positioned along the sliding sleeve 165 that are in sealing engagement with the external surface of the sliding sleeve 165 and an internal surface of the inner tubular 155 to fluidically isolate sections of an annulus formed between the inner tubular 155 and the sliding sleeve 165. Generally, a seal 185*a* is positioned between an upper end of the sliding sleeve and the plurality of openings 180, a seal 185*b* is positioned between a lower end of the sliding sleeve and plurality of openings 180, and a seal 185*c* is positioned between the plurality of openings 180 and the plurality of openings 158 when the first valve 120 is in the closed position.

In some embodiments, the first valve 120 also includes a locking collet 198 that is coupled to the sliding sleeve 165. In some embodiments, the first valve 120 also includes a flow limitation sub 200 that includes a coupler 200*a* that corresponds to a coupler 195*a* of the locking collet 198 such that the locking collet 198 and the flow limitation sub 200 are capable of being coupled via the couplers 195*a* and 200*a*. In some embodiments, axial movement of the flow limitation sub 200 is limited in one direction (e.g., in a downhole direction) relative to the inner tubular 155 via a shoulder 205 or other structural element that extends from the inner tubular 155. When the flow limitation sub 200 is used to stop the downward movement of the sliding sleeve 165, the length of the flow limitation sub in part determines the positioning of the openings 180 relative to the openings 158 when the first valve 120 is in an open position.

Generally, the plurality of openings 158 is similar to the openings 180. That is, the openings 158 extend through a wall of the inner tubular 155 and are longitudinally and/or circumferentially spaced along the inner tubular 155. The openings 158 and 180 are not limited to circular shapes, but may be any shape such as for example slots (straight or curved), etc.

When the first valve 120 is in the closed position, the sliding sleeve 165 is positioned such that the plurality of openings 180 are fluidically isolated from the openings 158 via the seals 185*a* and 185*c*, thereby fluidically isolating the differential chamber 115 from the fluid passageway 110. The locking collet 198 is also spaced from the flow limitation sub 200. Moreover, when in the closed position, the shear pins 175 are coupled to the sliding sleeve 165 and the inner tubular 155 to secure the sliding sleeve 165 relative to the inner tubular 155.

Figure 6:
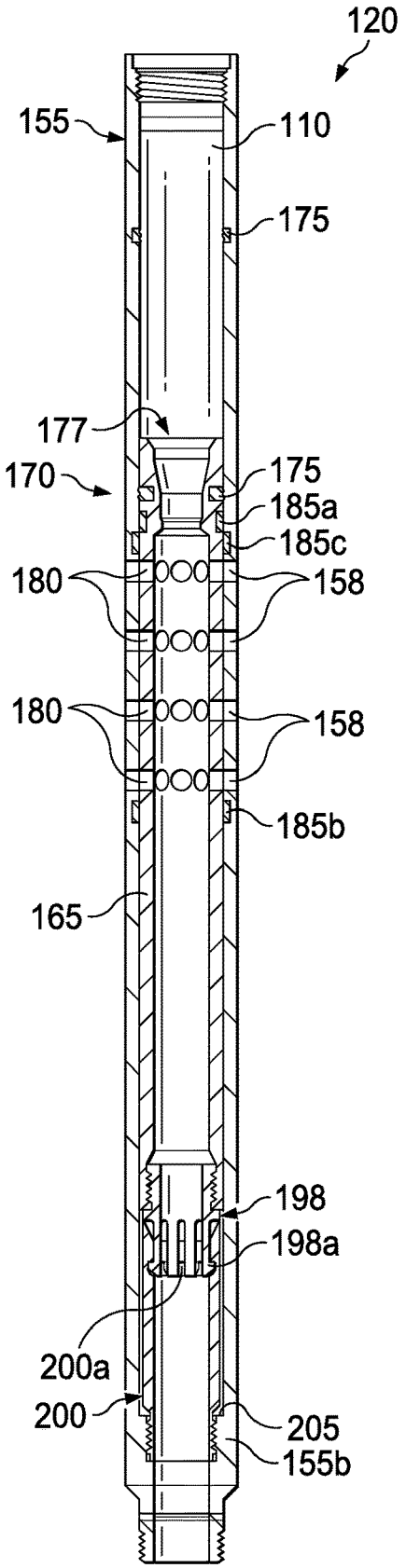
FIG. 6 illustrates a cross-sectional view of the valve of FIG. 2 in an open position, according to an embodiment of the present disclosure.

FIG. 6 illustrates the first valve 120 in an open position. When the first valve 120 is in the open position, the shear pins 175 have been sheared and the sliding sleeve 165 has been shifted relative to the inner tubular 155 such that the locking collet 198 is coupled to the flow limitation sub 200 to stop the downward movement of the sliding sleeve 165 relative to the inner tubular 155. As illustrated, the flow limitation sub 200 is a first length. When in the open position, the plurality of openings 180 are in fluid communication with the plurality of openings 158.

Figure 7:
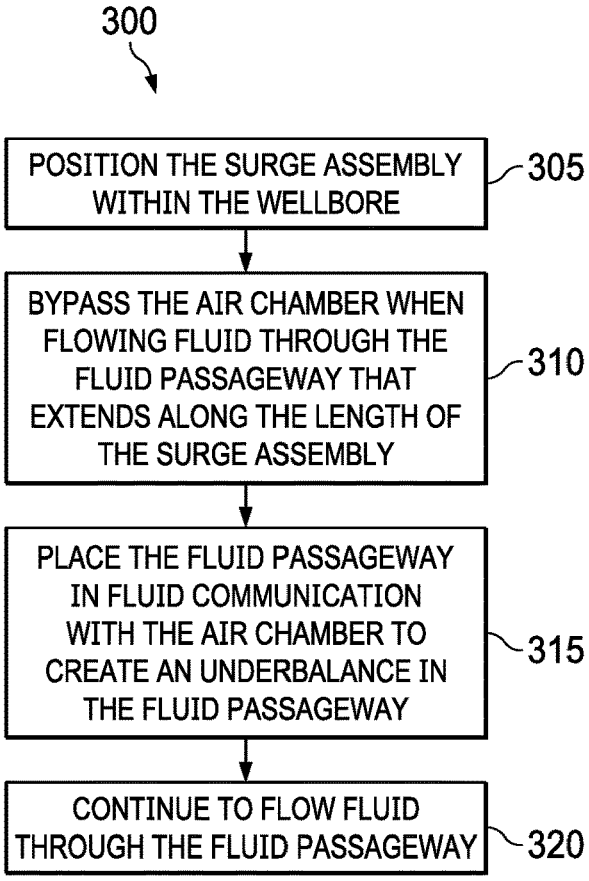
FIG. 7 illustrates a method of operating the surge assembly of FIG. 1, according to an example embodiment of the present disclosure.

FIG. 7 illustrates a method of operating surge assembly 95. The method is generally referred to by the reference numeral 300 and includes positioning the surge assembly 95 within the wellbore 80 at step 305; bypassing the differential chamber 115 when flowing fluid through the fluid passageway 110 at step 310; placing a portion of the fluid passageway 110 in fluid communication with the differential chamber 115 to create an underbalance in the fluid passageway 110 at step 315; and continuing to flow fluid through the fluid passageway 110 at step 320.

At the step 305, the surge assembly 95 is positioned within the wellbore 80. In some embodiments, the surge assembly 95 is positioned within the wellbore when the second valve 125 is in the closed position, but is opened via a ball drop to open the fluid passageways 110 and 88.

At the step 310, the fluid 168 flows through the fluid passageway 110 that extends through the length of the surge assembly 95 to bypass the differential chamber 115 when the first valve 120 is in the closed position (illustrated in FIG. 2). The fluid 168 within the fluid passageway 110 can be pressurized to activate any number of downhole tools, such as the downhole tool 90. For example, while the first valve 120 is in the closed position, the fluid 168 may be pressurized to pressurize the annulus 100, a lower MSV may be actuated, the well may be surged, guns may be fired, and test tools can be used to control the well.

At the step 315, the fluid passageway 110 is placed in fluid communication with the differential chamber 115 to create an underbalance or at least a temporary reduction in fluid pressure in the fluid passageway 110 at step 315. Generally, at the step 315, the first valve 120 is shifted from the closed position to the open position via a ball drop or other means. When the ball 169 lands on the ball seat 177 (illustrated in FIG. 3), the fluid passageway 110 is blocked such that an uphole portion 110*a* (relative to the ball 169) with the fluid 168*a* that is in communication with the surface is fluidically isolated or substantially fluidically isolated from a downhole portion 110*b* (relative to the ball 169) with fluid 168*b* that is in communication with an end portion of the working string 75 and/or the annulus 100. As such and when the valve 120 is shifted to an open position, the fluid 168*b* enters the differential chamber 115 from the downhole portion 110*b* of the fluid passageway 110. As the downhole portion 110*b* of the fluid passageway 110 is in fluid communication with the annulus 100, the annulus 100 is affected and an underbalance occurs (i.e., temporary reduction in downhole fluid pressure that is or is not lower than the formation pressure). In some embodiments, the surge assembly 95 is positioned above the perforation interval and the packers are reset before the valve 120 is opened.

At the step 320, the ball 169 is removed from the ball seat 177 and the fluid passageway 110 and the fluid 168 resumes flowing through the fluid passageways 88 and 110 (illustrated in FIG. 4). Even after the differential chamber 115 has received the fluid 168*b*, the fluid 168 can flow through the fluid passageways 88 and 110 to operate downhole tools, such as the downhole tool 90. In some embodiments and when the valve 120 is in the open position and when the ball 169 is no longer seated in the ball seat 177, the well is controlled via test tools without tripping out the working string 75.

Figure 8:
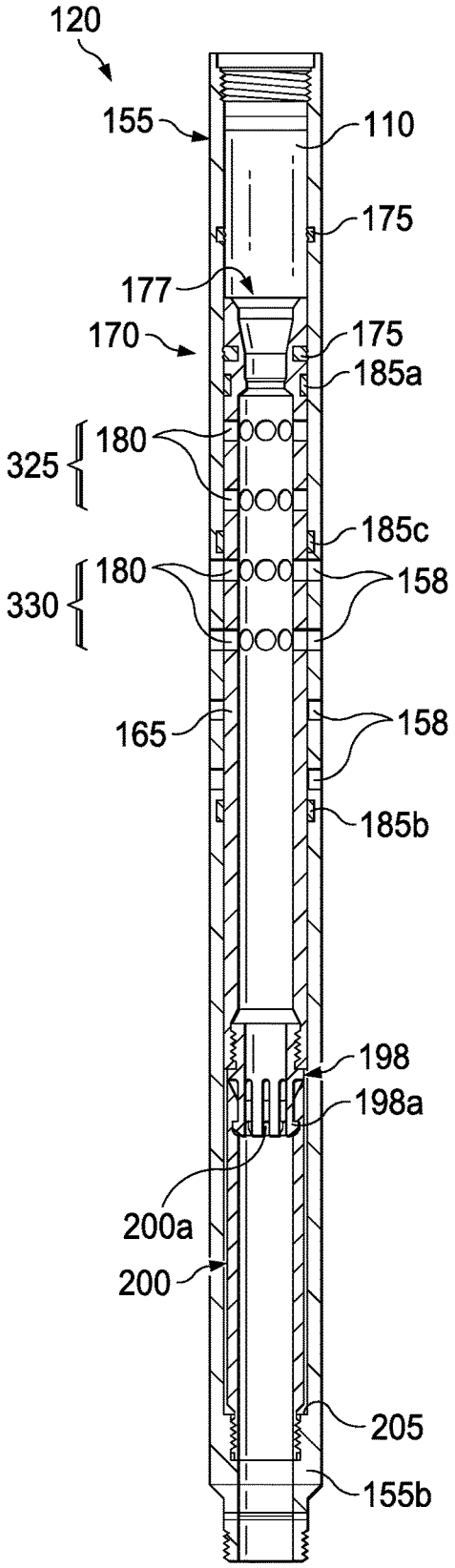
FIG. 8 illustrates a cross-sectional view of the valve of FIG. 2 in another open configuration, according to an embodiment of the present disclosure.

The surge assembly 95 and/or the method 300 may be altered in a variety of ways. FIG. 8 illustrates a cross-sectional view of the valve of FIG. 2 in another open configuration. More specifically, FIG. 8 illustrates the first valve 120 when the first valve 120 has been configured to open into another open position. When in the other open position, the shear pins 175 have been sheared and the sliding sleeve 165 has been shifted relative to the inner tubular 155 such that the locking collet 198 is coupled to the flow limitation sub 200 to stop the downward movement of the sliding sleeve 165 relative to the inner tubular 155. As illustrated, the flow limitation sub 200 is longer than the flow limitation sub 200 illustrated in FIGS. 5-6. As such, only a first plurality of openings 325 of the plurality of openings 180 is not in fluid communication with the openings 158 while a second plurality of openings 330 of the plurality of openings 180 is in fluid communication with the plurality of openings 158.

The plurality of openings 180 has a first total open surface area that is associated with a first target flow rate, and the plurality of openings 330 has a second total open surface area that is associated with a second target flow rate that is a portion of the first total open surface area. Thus, the second target flow rate is generally less than the first target flow rate in some embodiments. A target flow rate can be a target flow rate range and is not limited to a single numerical value target. By selecting the length of the flow limitation sub 200 at the surface of the well or at another location, the first valve 120 is an adjustable valve in that it can be configured for different target flow rates.

Figure 9:
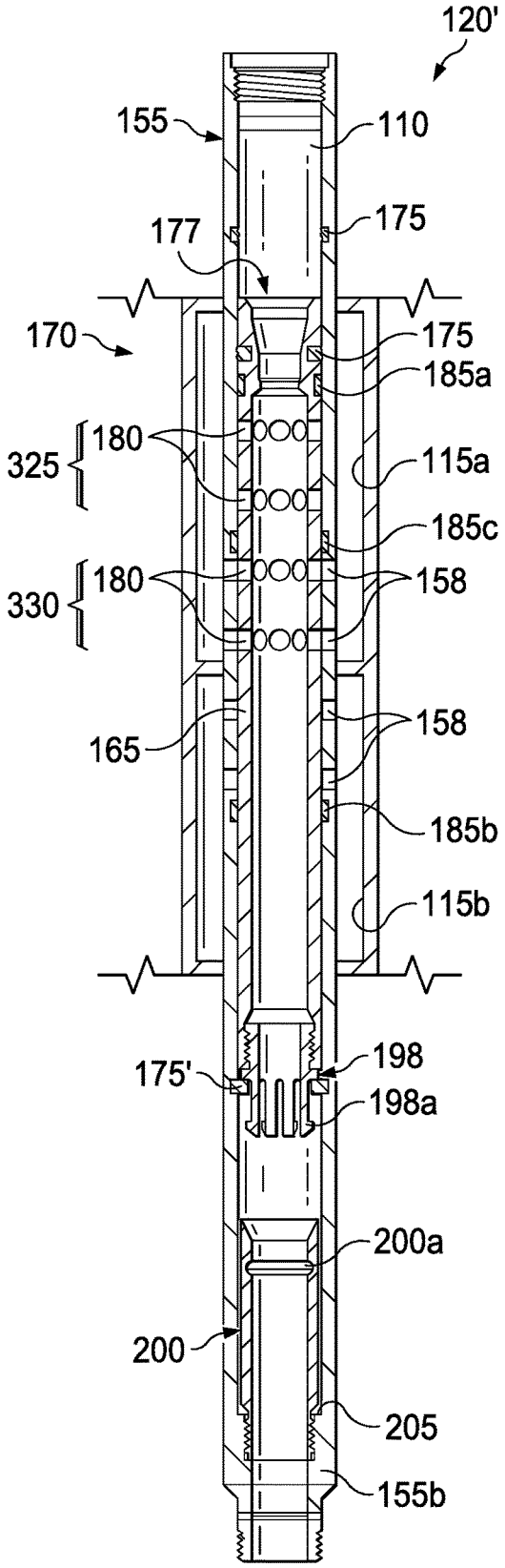
FIG. 9 illustrates a cross-sectional view of a portion of the surge assembly of FIG. 1 that includes another embodiment of the valve of FIG. 2, according to an embodiment of the present disclosure.

In some embodiments, the first valve 120 is adjustable while it is positioned downhole. FIG. 9 illustrates a cross-sectional view of a portion of the surge assembly of FIG. 1 that includes another embodiment of the valve of FIG. 2. Another embodiment of the first valve 120 is designated by reference numeral 120' in FIG. 9. Generally, the first valve 120' is shiftable between open positions, with the movement from the closed position to a first open position being similar to the movement described above with reference to FIG. 6 except that the locking collet 198 does not couple with the flow limitation sub 200. Instead, the downward movement of the sliding sleeve 165 is stopped by an element that extends from or is formed from the inner surface of the inner tubular 155, such as a second set of shear pins 175'. That is, the sliding sleeve 165 can be moved past the element when a sufficient force is applied to the sliding sleeve 165, such as for when the pressure is further increased when the ball 169 is resting on the ball seat 177. When the second set of shear pins 175' are sheared, the sliding sleeve 165 then moves downward to couple with the flow limitation sub 200 to place the first valve 120' in a second open position. In some embodiments, the differential chamber 115 is sectioned into two differential chambers 115*a* and 115*b* by a divider and when the first valve 120' is in the first open position, the first differential chamber 115*a* is filled and when the first valve 120' is in the second open position, the second differential chamber 115*b* is filled.

For example, when the first valve 120 is shiftable between a first open position and a second open position while downhole and when the differential chamber 115 is divided into multiple fluidically isolated differential chambers 115*a* and 115*b*, the first valve 120' shifts from the closed position to the first open position to allow the fluid 168*b* to enter the first differential chamber 115*a* via a ball drop and further shifts from the first open position to the second open position to allow the fluid 168*b* to enter the second differential chamber 115*b* via the same ball drop or different ball drops. As such, the activation of multiple differential chambers can be realized without the need for short tripping to install a new set of ball valves.

However, in other embodiments the differential chamber 115 is not sectioned into two chambers 115*a* and 115*b*, and shifting the first valve 120' from one open position to another open position increases the number of openings in fluid communication with the plurality of openings 158 to increase the flow rate of the first valve 120'. In some embodiments, shifting the first valve 120' from one open position to another open position replaces the openings in fluid communication with the plurality of openings 158 with another plurality of openings, thereby changing the flow rate of the first valve 120'.

Figure 10:
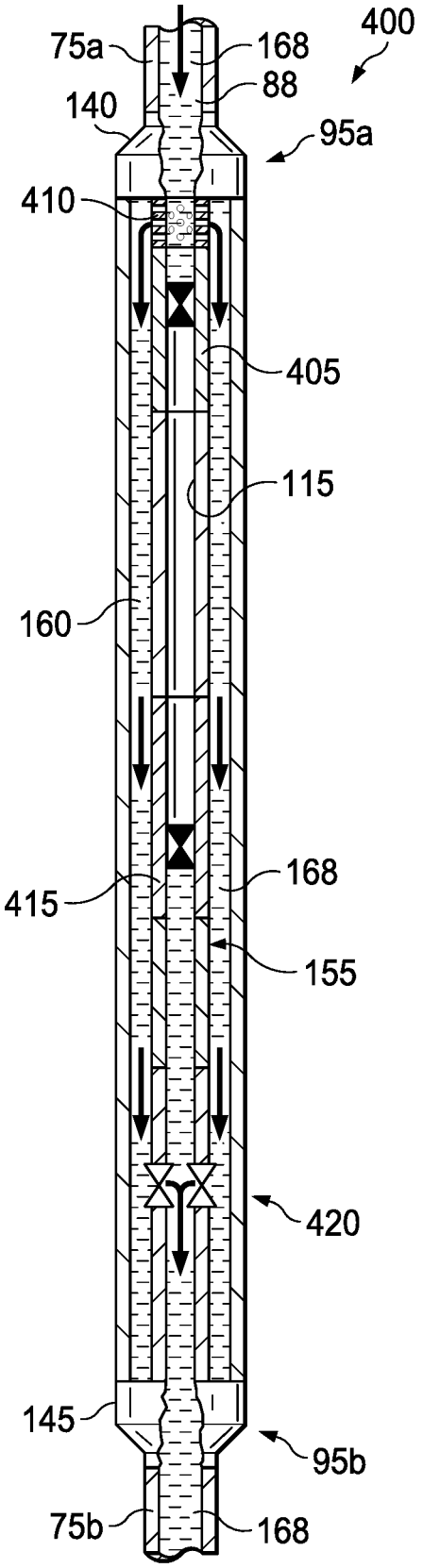
FIG. 10 illustrates a cross-sectional view of the surge assembly of FIG. 1 in a first configuration, according to another embodiment of the present disclosure.

FIG. 10 illustrates a cross-sectional view of the surge assembly of FIG. 1 in a first configuration. Another embodiment of the surge assembly 95 is illustrated in FIG. 10 and identified with the reference numeral 400. The surge assembly 400 is similar to the surge assembly 95 except the fluid passageway is formed around the differential chamber 115. In this embodiment, the surge assembly also includes an upper MSV 405 that is positioned along the inner tubular 155 to fluidically isolate the uphole portion 110*a* of the fluid passageway 110 from the differential chamber 115, a perforation sub 410 positioned between the upper MSV 405 and the crossover 140 to allow the fluid 168 to bypass the differential chamber 115 and enter the annulus 160 formed between the inner tubular 155 and the outer tubular 135, a lower MSV 415 that is positioned between the differential chamber 115 and the crossover 145 to fluidically isolate the downhole portion 110*b* of the fluid passageway 110 from the differential chamber 115, and a valve 420 that is positioned along the inner tubular 155 that, when opened, allows the fluid 168 to pass to/from the annulus 160 and the inner tubular 155. Generally, the surge assembly 400 is positioned in the wellbore 80 when the upper MSV 405 and the lower MSV 415 are in the closed position as illustrated in FIG. 10. When in this first configuration, the fluid 168 flows from the fluid passageway 88 in the first tubular 75*a*, through the ported sub 410 into the annulus 160, and from the annulus 160 into the inner tubular 155 to bypass the differential chamber 115. Operation of downhole tools, such as the downhole tool 90, is performed in this first configuration. When the differential chamber 115 is to be flooded, the valve 420 is closed to isolate the fluid 168*a* that is in communication with the surface from the fluid 168*b* that is in communication with an end portion of the working string 75 and/or the annulus 100. The lower MSV 415 is then placed into an open position.

Figure 11:
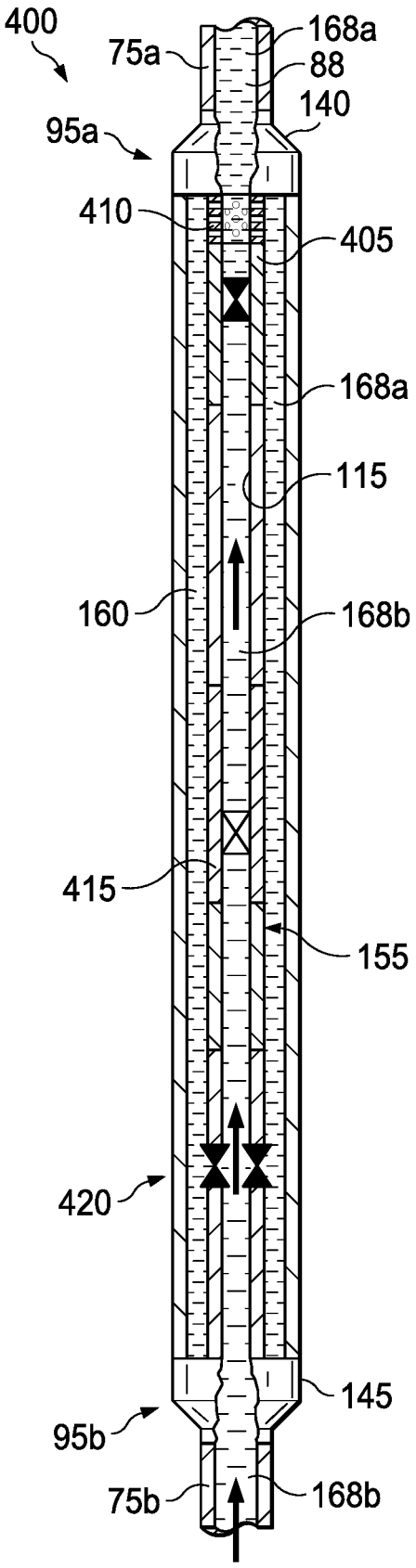
FIG. 11 illustrates a cross-sectional view of the surge assembly of FIG. 10 in a second configuration, according to an embodiment of the present disclosure.

FIG. 11 illustrates a cross-sectional view of the surge assembly of FIG. 10 in a second configuration. When in this second configuration, the valve 420 is closed, the lower MSV 415 is open, and the fluid 168*b* from the downhole portion 110*b* of the fluid passageway 110 enters the differential chamber 115 to create an underbalance in the wellbore 80.

Figure 12:
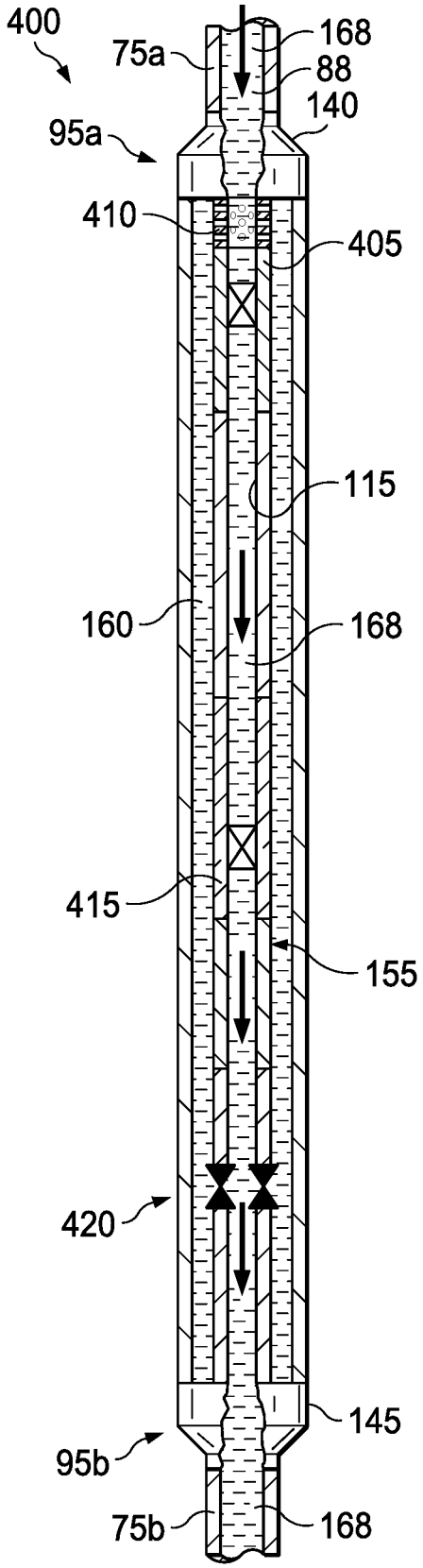
FIG. 12 illustrates a cross-sectional view of the surge assembly of FIG. 10 in a third configuration, according to an embodiment of the present disclosure.

FIG. 12 illustrates a cross-sectional view of the surge assembly of FIG. 10 in a third configuration. After the underbalance has occurred, the upper MSV 405 is opened such that the differential chamber 115 becomes a portion of the fluid passageways 110 and 88. When in this third configuration, well operations may be completed in a similar manner to that of the surge assembly 95.

In some embodiments, and for casing with smaller sizes, the differential chamber 115 is positioned lower in the well, below the well control tools enabling the use of the tubing to control the well.

In some embodiments, the ball 169 used to actuate any of the valves may be extruded through the ball seat or reversed out of the wellbore.

Generally, the method 300, the assembly 95, and/or the assembly 400 results in the completion of well operations downhole from the surge assembly 95 or 400 before and after the differential chamber 115 is flooded or receives the fluid 168*b*. As such, this allows for improved well control. In some embodiments, the method 300, the assembly 95, and/or the assembly 400 results in perforation and surge of a reservoir in a single trip, which improves rig efficiency. Unlike conventional surge assemblies that eliminate the use of an associated tubing as a fluid conduit, the surge assemblies 95 and 400 allow for the use of the fluid passageway 110 as a conduit prior to and after the surging or flooding of the differential chamber 115. Moreover, conventional surge assemblies restrict the use of the surge assembly as a conduit due to the use of ball valves required by the conventional surge assembly. As such, with conventional surge assemblies, additional operations (e.g., trips downhole) or equipment is needed to complete the well completion operations.

Moreover, and in some embodiments, the valve 120 restricts the surge to make the surging event last longer. In some embodiments, the option of configuring the valve to open to the first open position or the second open position allows for the speed at which the fluid enters the chamber 115 to be altered or adjusted. In some embodiments, slowing the surging event (e.g., the fluid entering the differential chamber 115) increases the surging event and increases the effectiveness of the surge. When the valve 120 is shiftable from the first open position to the second open position, additional customization to the surge event is provided without requiring a short trip or entire trip out of the working string 75.

In several example embodiments, while different steps, processes, and procedures are described as appearing as distinct acts, one or more of the steps, one or more of the processes, and/or one or more of the procedures may also be performed in different orders, simultaneously and/or sequentially. In several example embodiments, the steps, processes and/or procedures may be merged into one or more steps, processes and/or procedures. In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Thus, a method of providing an underbalance in a wellbore is provided. Embodiments of the method may include positioning a surge assembly within the wellbore; bypassing a differential chamber that extends along a portion of the length of the surge assembly when flowing fluid through a fluid passageway that extends along the length of the surge assembly; and placing the fluid passageway in fluid communication with the differential chamber to create an underbalance in the fluid passageway. For any of the foregoing embodiments, the method may include any one of the following elements, alone or in combination with each other:

- The surge assembly forms a portion of a working string that extends from a surface of the wellbore.
- The surge assembly is positioned, along the working string, between the surface of the wellbore and a downhole tool.
- The method further includes operating the downhole tool using the fluid passageway after placing the fluid passageway in fluid communication with the differential chamber.
- The surge assembly includes a first tubular that forms the fluid passageway; and a second tubular that is disposed about the first tubular to create a first annulus that forms the differential chamber.
- The method further includes placing the fluid passageway in fluid communication with the differential chamber includes opening a valve that is formed in a wall of the first tubular.
- The surge assembly forms a portion of a working string.
- The fluid passageway extends within the working string from a surface of the wellbore, through the surge assembly, and to an end portion of the working string.
- The method further includes opening the valve that is formed in the wall of the first tubular fluidically isolates a portion of the fluid passageway that extends towards the surface of the wellbore from a portion of the fluid passageway that extends to the end portion of the working string.
- The method further includes opening the valve places the portion of the fluid passageway that extends to the end portion of the working string with the differential chamber.
- The portion of the fluid passageway that extends to the end portion of the working string is in fluid communication with a second annulus formed between the working string and the wellbore such that opening the valve places the second annulus in fluid communication with the differential chamber.

The method further includes determining a first target flow rate range for the valve.

The method further includes opening the valve that is formed in the wall of the first tubular includes opening the valve to a first position that corresponds with the first target flow rate range.

The valve includes a ball seat.

The method further includes opening the valve includes landing a ball in the ball seat; and pressurizing the fluid in a portion of the fluid passageway that extends towards the surface of the wellbore while the ball is landed in the ball seat to shift the valve to the first position.

The method further includes shifting the valve to a second position that corresponds to a second target flow rate range that is different from the first target flow rate range.

The surge assembly forms a portion of a working string that extends from a surface of the wellbore.

The surge assembly is positioned, along the working string, between the surface of the wellbore and a downhole tool.

The method further includes pressurizing the fluid within the fluid passageway to activate the downhole tool while bypassing the differential chamber.

The surge assembly includes a third tubular that forms the differential chamber; and a fourth tubular that is disposed about the third tubular to create an annulus that forms the fluid passageway.

Thus, a surge assembly is provided. Embodiments of the surge assembly may include a housing that defines a first end and a second opposing end; a first tubular positioned within the housing and forming an differential chamber; and a valve movable from a closed position to a first open position, wherein, when in the closed position, the valve fluidically isolates the differential chamber from a fluid passageway that extends along a length of the housing; and wherein, when in the first open position, the valve allows fluid from the fluid passageway to enter the differential chamber to reduce the pressure of the fluid within a portion of the fluid passageway. For any of the foregoing embodiments, the method may include any one of the following elements, alone or in combination with each other:

The surge assembly includes a second tubular that defines the fluid passageway.

The first tubular is a shroud disposed about the second tubular to define an annulus between an external surface of the second tubular and an internal surface of the first tubular.

The annulus forms the differential chamber.

The surge assembly defines a center longitudinal axis.

The fluid passageway extends along the entirety of the center longitudinal axis of the surge assembly.

The valve forms a portion of the second tubular.

A first plurality of openings extends through a wall of the portion of the second tubular that forms the valve.

The valve includes a sliding sleeve positioned within the second tubular and having a second plurality of openings extending through a wall of the sliding sleeve; and seal(s) in sealing arrangement between the second tubular and the sliding sleeve.

When the valve is in the closed position, the sliding sleeve is longitudinally positioned relative to the second tubular such that the first plurality of openings is fluidically isolated from the second plurality of openings using the seal(s).

When the valve is in the first open position, the sliding sleeve is longitudinally positioned relative to the second tubular such that the first plurality of openings is in fluid communication with the second plurality of openings.

The sliding sleeve has a third plurality of openings extending through the wall of the sliding sleeve.

The third plurality of openings are longitudinally spaced along the wall of the sliding sleeve and from the first plurality of openings.

When in a second open position, the sliding sleeve is longitudinally positioned relative to the second tubular such that the third plurality of openings are in fluid communication with the first plurality of openings.

When the valve is in the second open position, the second plurality of openings is fluidically isolated from the first plurality of openings via the seal(s).

The third plurality of openings has a total surface area that is different from a total surface area associated with the second plurality of openings.

The valve includes shear pin(s) coupled to each of the second tubular and the sliding sleeve.

The surge assembly forms a portion of a working string that extends from a surface of a wellbore.

The surge assembly is positioned, along the working string, between the surface of the wellbore and a downhole tool.

The downhole tool is in fluid communication with the fluid passageway and actuated upon increasing a fluid pressure of the fluid within the fluid passageway before or after the fluid enters the differential chamber.

The surge assembly also includes a third tubular that is disposed about the first tubular; and the fluid passageway is formed in an annulus formed between the external surface of the first tubular and an internal surface of the third tubular.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the example term "below" may encompass both an orientation of above and below. The apparatus may be otherwise oriented (rotated 90 degrees or at other orientations) and the spatially relative descriptors used herein may likewise be interpreted accordingly.

What is claimed is:

1. A method of providing an underbalance in a wellbore, the method comprising:

positioning a surge assembly within the wellbore;

bypassing a differential chamber that extends along a portion of the length of the surge assembly when flowing fluid through a fluid passageway that extends along the length of the surge assembly; and placing the fluid passageway in fluid communication with the differential chamber to create an underbalance in the fluid passageway;

wherein the surge assembly comprises:

a first tubular that forms the fluid passageway; and a second tubular that is disposed about the first tubular to create a first annulus that forms the differential chamber;

wherein the surge assembly forms a portion of a working string;

wherein the fluid passageway extends within the working string from a surface of the wellbore, through the surge assembly, and to an end portion of the working string;

wherein opening a valve that is formed in the wall of the first tubular fluidically isolates a portion of the fluid passageway that extends towards the surface of the wellbore from a portion of the fluid passageway that extends to the end portion of the working string;

wherein opening the valve places the portion of the fluid passageway that extends to the end portion of the working string in fluid communication with the differential chamber;

wherein the method further comprises determining a first target flow rate range for the valve; and wherein opening the valve that is formed in the wall of the first tubular comprises opening the valve to a first position that corresponds with the first target flow rate range.

2. The method of claim 1, wherein the valve comprises a ball seat; and wherein opening the valve comprises:

landing a ball in the ball seat; and pressurizing the fluid in the portion of the fluid passageway that extends towards the surface of the wellbore while the ball is landed in the ball seat to shift the valve to the first position.

3. The method of claim 1, further comprising shifting the valve to a second position that corresponds to a second target flow rate range that is different from the first target flow rate range.

4. A method of providing an underbalance in a wellbore, the method comprising:

positioning a surge assembly within the wellbore;

bypassing a differential chamber that extends along a portion of the length of the surge assembly when flowing fluid through a fluid passageway that extends along the length of the surge assembly; and placing the fluid passageway in fluid communication with the differential chamber to create an underbalance in the fluid passageway;

wherein the surge assembly forms a portion of a working string that extends from a surface of the wellbore;

wherein the surge assembly is positioned, along the working string, between the surface of the wellbore and a downhole tool; and wherein the method further comprises pressurizing the fluid within the fluid passageway to activate the downhole tool while bypassing the differential chamber.

5. The method of claim 4, wherein the method further comprises operating the downhole tool using the fluid passageway after placing the fluid passageway in fluid communication with the differential chamber.

6. The method of claim 5, wherein the surge assembly comprises:

a first tubular that forms the differential chamber; and a second tubular that is disposed about the first tubular to create an annulus that forms the fluid passageway.

7. The method of claim 4, wherein the surge assembly comprises:

a first tubular that forms the fluid passageway; and a second tubular that is disposed about the first tubular to create a first annulus that forms the differential chamber.

8. The method of claim 7, wherein placing the fluid passageway in fluid communication with the differential chamber comprises opening a valve that is formed in a wall of the first tubular.

9. The method of claim 8, wherein the fluid passageway extends within the working string from the surface of the wellbore, through the surge assembly, and to an end portion of the working string;

wherein opening the valve that is formed in the wall of the first tubular fluidically isolates a portion of the fluid passageway that extends towards the surface of the wellbore from a portion of the fluid passageway that extends to the end portion of the working string; and wherein opening the valve places the portion of the fluid passageway that extends to the end portion of the working string in fluid communication with the differential chamber.

10. The method of claim 9, wherein the portion of the fluid passageway that extends to the end portion of the working string is in fluid communication with a second annulus formed between the working string and the wellbore such that opening the valve places the second annulus in fluid communication with the differential chamber.

11. The method of claim 4, wherein the surge assembly is oriented within the wellbore so that a first portion of the fluid passageway is positioned downhole from a second portion of the fluid passageway.

* * * * *